United States Patent [19]

Kendrick et al.

[11] 4,450,381

[45] May 22, 1984

[54] TUNGSTEN-HALOGEN LAMP WITH PREFERENTIAL TUNGSTEN DEPOSITION SITE

[75] Inventors: George B. Kendrick, Lexington, Ky.; George L. Duggan, Bedford, Mass.; Carlos Ochoa, El Paso, Tex.

[73] Assignee: GTE Products Corporation, Stamford, Conn.

[21] Appl. No.: 365,667

[22] Filed: Apr. 5, 1982

[51] Int. Cl.[3] ..... H01K 1/04

[52] U.S. Cl. ..... 313/579; 313/559; 313/557

[58] Field of Search ..... 313/578, 579, 332, 557–559

[56] References Cited

U.S. PATENT DOCUMENTS 3,717,784 2/1973 Matheson ..... 313/579
4,297,611 10/1981 Cortorillo ..... 313/579

OTHER PUBLICATIONS

Fitzpatrick et al., "Progress Towards a Practical Flourine Lamp", Light Res. & Technol. (GB) vol. 11, No. 2, 1979, pp. 85–89.

*Primary Examiner*—Eugene R. LaRoche
*Assistant Examiner*—Vincent De Luca
*Attorney, Agent, or Firm*—Thomas H. Buffton

[57] ABSTRACT

A tungsten-halogen incandescent lamp has a hermetically sealed light-transmitting envelope with a fill of inert gas and halogen, a tungsten filament and a preferential tungsten deposition site of palladium material within the envelope.

10 Claims, 8 Drawing Figures

TUNGSTEN-HALOGEN LAMP WITH PREFERENTIAL TUNGSTEN DEPOSITION SITE

TECHNICAL FIELD

This invention relates to tungsten-halogen incandescent lamps and more particularly to a tungsten-halogen lamp having a preferred site therein for deposition of excess tungsten.

BACKGROUND ART

In a tungsten-halogen lamp, tungsten particles evaporate from the hot filament and are carried by convection currents to the relatively cool envelope wall. When the temperature of the lamp envelope is sufficiently high, such as on the order to 250° C. or greater, a tungsten halide is formed in the vicinity of the envelope or bulb wall. This tungsten halide does not adhere to the wall but is borne by convection currents back to the filament. The high temperatures at the filament (which may exceed 2500° C.) reduce the tungsten halide into tungsten which redeposits on the filament, and a free halide (such as bromine) in the vapor state is formed which recirculates to continue the regenerative cycle. This halogen regenerative cycle is well known, and the principles have been applied to commercially sold lamps. See, for example, U.S. Pat. Nos. 3,829,729 and 3,847,687 which describe tungsten halogen lamps and particularly those employing a tantalum wire getter. Also, refer to U.S. Pat. No. 4,096,405 which shows an incandescent lamp employing a getter within the envelope. Other tungsten-halogen lamps are shown in U.S. Pat. Nos. 3,346,671, 3,453,476, and 3,821,585.

Also, it is believed that a constant stable optimum quantity of hydrogen within a tungsten-halogen lamp is vital for long lamp life. Observations indicate that an insufficiency of hydrogen within the lamp is accompanied by corrosion or attack on the relatively cool ends of the tungsten filament. Moreover, this attack is believed to be caused by increased chemical activity of the bromine within the lamp. Further, it is theorized that failure of the lamp is due to the undesired loss of the hydrogen from the lamp due to diffusion thereof through the walls of the envelope. Unfortunately, the loss of hydrogen during operation of the lamp cannot be compensated for by the addition of excess hydrogen during lamp manufacture because the halogen cycle would be supressed and blackening of the envelope would occur due to an excess of tungsten evaporated from the filament.

Thus, it would be advantageous to provide a reservoir within a tungsten-halogen lamp whereby hydrogen would be absorbed prior to hermetic sealing of the lamp. Moreover, the hydrogen reservoir would provide a continual supply of hydrogen after hermetic sealing of the lamp has been effected. Also, it would be desirable to provide a preferential site for deposition thereon of any excess tungsten evaporated during the life cycle of the lamp.

SUMMARY OF THE INVENTION

An object of the present invention is to provide an improved tungsten-halogen lamp. Another object of the invention is to enhance the operational life of a tungsten-halogen lamp. Still another object of the invention is to provide a substantially constant supply of hydrogen in a sealed tungsten-halogen lamp. A further object of the invention is to provide a preferential site for tungsten deposition in a tungsten-halogen lamp.

These and other objects, advantages and capabilities are achieved in one aspect of the invention by a tungsten-halogen lamp having a hermetically sealed envelope filled with an inert gas and halogen with a tungsten filament supported therein and a reservoir for hydrogen and a preferential deposition site for tungsten located within the envelope.

BEST MODE FOR CARRYING OUT THE INVENTION

For a better understanding of the present invention, together with other and further objects, advantages and capabilities thereof, reference is made to the following disclosure and appended claims in conjunction with the accompanying drawings.

Figure 1:
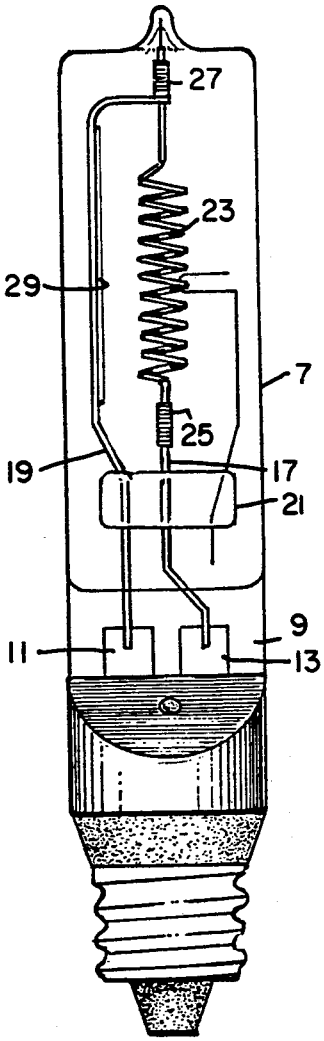
FIG. 1 is an illustration of a preferred form of tungsten-halogen lamp embodying the invention.
Figure 2:
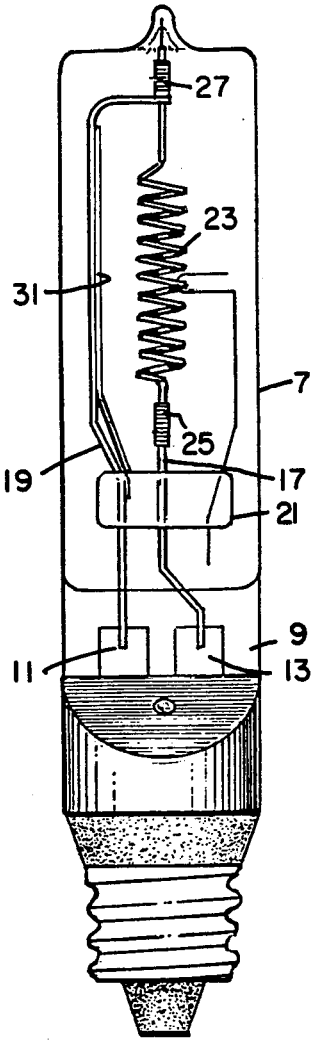
FIG. 2 is an alternative form of the tungsten-halogen lamp of FIG. 1.

Referring to the drawings, FIGS. 1 and 2 serve to illustrate two embodiments of slightly different configuration but sufficiently similar to permit use of like reference characters to identify similar parts. In these examples, both embodiments include a light transmitting hermetically sealed envelope 7 which is generally tubular in shape. The structures each have a press-seal base 9 and a pair of platinum foil seals 11 and 13 which serve to interconnect electrically conductive leads (not shown) and a pair of electrically conductive internal support members 17 and 19.

A glass bridge assembly 21 is located within the envelope 7 and electrically conductive internal support members 17 and 19 pass through the bridge assembly 21 and extend inwardly of the envelope 7. A tungsten filament 23 is connected to one of the internal support members 17 by a first overwind section 25 and to the other internal support 19 by a second overwind section 27.

Generally, a material having a relatively high melting temperature, such as quartz, is used for the envelope 7 although other hard glasses may be employed. The hermetically sealed envelope 7 is usually filled with an inert gas, such as argon, nitrogen, krypton or a mixture thereof, and a halogen additive, such as iodine or bromine. Moreover, a hydrogen bromide mixture is preferred.

Referring back to the example of FIG. 1, therein a palladium wire 29 is affixed to the internal support 19 and positioned in parallel with but spaced from the tungsten filament 23. In FIG. 2, the palladium wire 31 is not only affixed to the internal support 19 but also extends down into the press-seal base 9. Although illustrated as a palladium wire, a powder such as palladium black, cold worked wire or ribbon or etched pieces of wire or ribbon are also appropriate and applicable to the structures.

Figure 3:
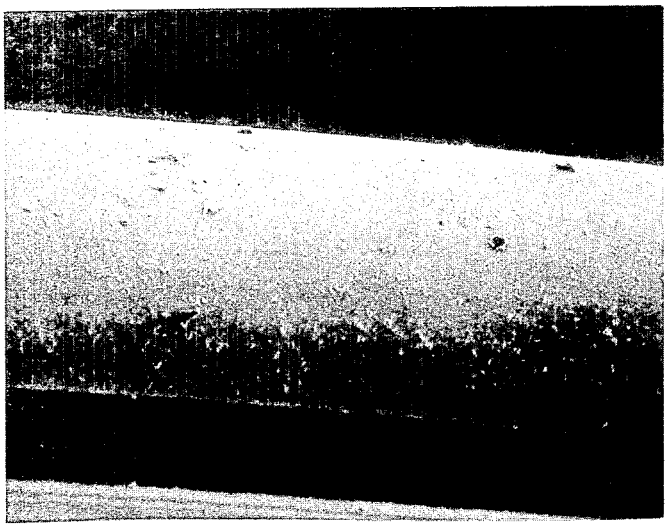
FIGS. 3 and 4 are pictorial representations, magnified 200 times, of a palladium wire prior to and after about 1000 hours of operation in a tungsten-halogen lamp.
Figure 4:
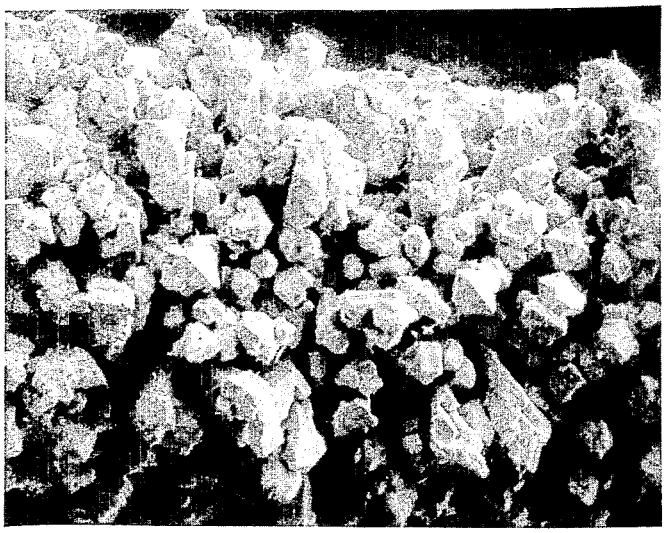
Figure 5A:
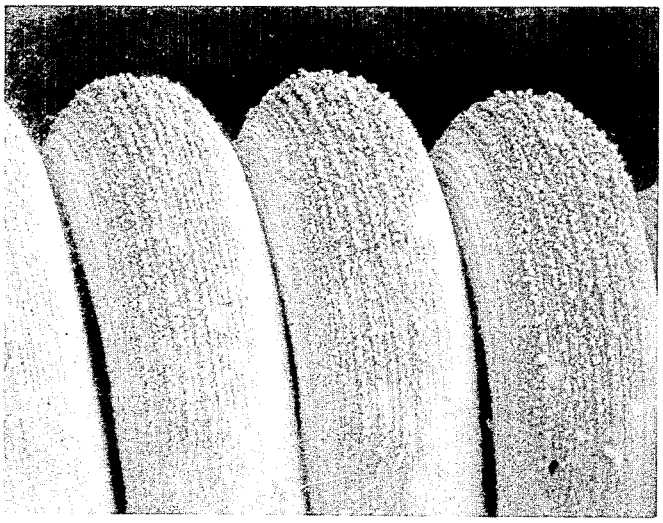
FIGS. 5A and 5B illustrate an overwind portion of a tungsten-halogen lamp, after operation and magnified 2000 times, wherein palladium is not present in the lamp.
Figure 5B:
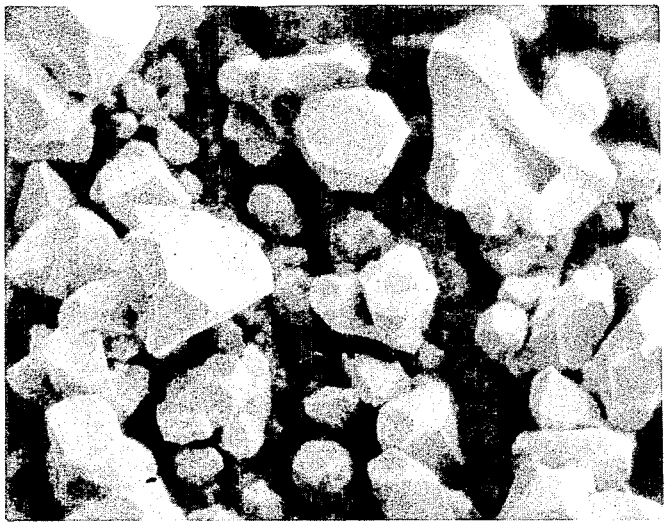
Figure 6A:
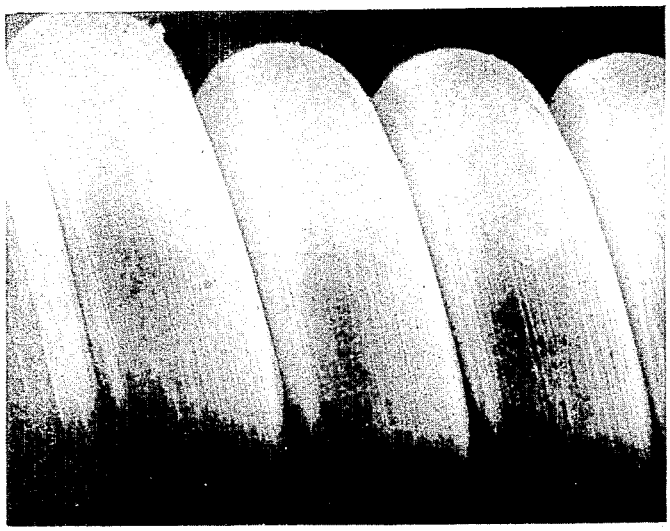
FIGS. 6A and 6B are a comparison with the illustration of FIGS. 5A and 5B showing a tungsten-halogen lamp overwind portion, after operation and magnified 2000 times, wherein palladium is present in the lamp.
Figure 6B:
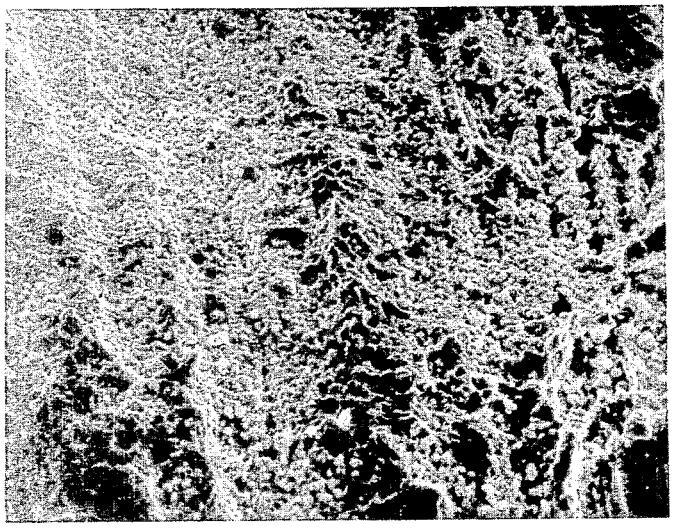

Although the inclusion of the above-mentioned palladium 29 or 31 within the envelope 7 did produce the desired result and enhance the life tests of the tungsten-halogen lamps, it was unexpectedly discovered that the palladium 29 or 31 was undergoing a surface chemical reaction which increased with operational time. As can be seen in the illustrations of FIGS. 3 and 4, the palladium 29 or 31 of FIG. 3, magnified 200 times, prior to operation exhibits a relatively smooth surface which the palladium 29 or 31 of FIG. 4 examined after about 1000 hours of operational life exhibits a very crystalline-like surface. Moreover, the crystalline-like surface of the palladium wire 29 or 31 of FIG. 4 appears to be primarily tungsten with low levels of palladium, oxygen and nitrogen when analyzed to a surface depth of about 1 μm. Thus, it would appear that the palladium serves as a preferential site for tungsten deposition.

Additionally, it has been discovered that the presence of the palladium within the envelope 7 tended to have a "cleaning" effect on the associated elements within the envelope 7. In other words, it appears that the palladium exhibits some chemical mechanism wherein the palladium acts as a preferential site for excess tungsten deposition. Moreover, the excess tungsten deposits thereon without any measurable or distinguishable interference with the normal halogen cycle.

As can be more readily seen in a comparison of the illustrations of FIGS. 5A and 5B and 6A and 6B, the control test 5A and 5B wherein the preferred tungsen deposition site, palladium in this example, is not present exhibits a marked increase in tungsten deposits on an overwind section 25 after a period of operational life. In contrast, the structure of FIGS. 6A and 6B which includes the preferred tungsten deposition site shows a marked decrease in tungsten deposits on an overwind section 25. Thus, it can readily be noted that a tungsten-halogen lamp having palladium therein tends to exhibit increased tungsten deposits on the palladium and markedly decreased tungsten deposits on surrounding elements within the structure.

As a further indication of the enhanced results obtained with the inclusion of a preferential site for tungsten deposition within a tungsten-halogen lamp, the following test results were obtained:

| LIFE TEST @ 120 VOLTS | Avg. Life (Hrs.) |
|---|---|
| Control (No preferred tungsten site) | 524 |
| Test (0.25 mm diameter palladium wire) | 840 |

As can readily be seen by the above-mentioned comparison, the presence of a preferred tungsten site, such as 0.25 mm diameter palladium wire, within a tungsten-halogen lamp provides an improvement in life test results of about 60%. Thus, a unique enhanced structure providing a greatly improved result has been provided.

While there has been shown and described what is at present considered the preferred embodiments of the invention, it will be obvious to those skilled in the art that various changes and modifications may be made therein without departing from the invention as defined by the appended claims.

We claim:

1. A tungsten-halogen incandescent lamp having a hermetically sealed light-transmitting envelope containing a fill of inert gas and halogen and a coiled tungsten filament supported within the envelope and characterized by the improvement wherein a preferential tungsten deposition site of palladium material is located within said envelope.

2. The improvement of claim 1 wherein said preferential tungsten deposition site is in the form of a palladium powder.

3. The improvement of claim 1 wherein said preferential tungsten deposition site is in the form of a palladium wire.

4. The improvement of claim 1 wherein said preferential tungsten deposition site is in the form of a palladium wire having a diameter of about 0.25 mm.

5. The improvement of claim 1 wherein said preferential tungsten deposition site is in the form of a palladium wire mounted within said envelope spaced from and parallel to said coiled tungsten filament.

6. The improvement of claim 1 wherein said preferential tungsten deposition site is in the form of a palladium wire mounted within said envelope and affixed to a lead spaced from and parallel to said tungsten filament.

7. The improvement of claim 1 wherein said preferential tungsten deposition site is in the form of an etched piece of palladium.

8. In a tungten-halogen incandescent lamp having a hermetically sealed light-transmitting envelope, a pair of electrically conductive leads passing through said envelope, a tungsten filament supported by said pair of electrically conductive leads within said envelope and a fill of inert gas and halogen within said envelope, the improvement comprising a preferential deposition site of palladium material for tungsten deposition located within said envelope.

9. The improvement of claim 8 wherein said preferential site for tungsten deposition is in the form of a palladium powder located within said envelope.

10. The improvement of claim 8 wherein said preferential site for tungsten deposition is in the form of a palladium wire spaced from and extending parallel to said tungsten filament.

* * * * *